US005871399A

United States Patent [19]

Emerson

[11] Patent Number: 5,871,399

[45] Date of Patent: Feb. 16, 1999

[54] FLAP WHEEL

[75] Inventor: Grahame W. Emerson, Anaheim, Calif.

[73] Assignee: Merit Abrasive Products, Inc., Compton, Calif.

[21] Appl. No.: 887,242

[22] Filed: Jul. 2, 1997

Related U.S. Application Data

[63] Continuation-in-part of Ser. No. 706,438, Aug. 30, 1996, Pat. No. 5,722,881.

[51] Int. Cl.[6] ..... B24D 13/06

[52] U.S. Cl. ..... 451/466; 451/464; 451/468

[58] Field of Search ..... 451/465, 466, 451/468, 464, 469, 486, 344

[56] References Cited

U.S. PATENT DOCUMENTS

| | | | |
|---|---|---|---|
| 2,642,705 | 6/1953 | Jensen | 451/468 |
| 2,907,145 | 10/1959 | Hall et al. | 451/468 |
| 3,357,141 | 12/1967 | Annis | 451/466 |
| 3,795,498 | 3/1974 | Hasegawa | 451/466 |
| 4,441,349 | 4/1984 | Symons | 451/465 |
| 4,872,292 | 10/1989 | Block | 451/466 |

FOREIGN PATENT DOCUMENTS

| | | | |
|---|---|---|---|
| 446626 | 9/1991 | European Pat. Off. | 451/466 |
| 226274 | 10/1986 | Japan | 451/466 |
| 1556887 | 4/1990 | U.S.S.R. | 451/466 |

*Primary Examiner*—Eileen P. Morgan
*Attorney, Agent, or Firm*—Ellsworth R. Roston; Fulwider Patton Lee & Utecht, LLP

[57] ABSTRACT

In one embodiment, a support member on an abrasive wheel has (a) an annular surface which fixedly supports (as by epoxy) a plurality of flaps in a partially overlapping relationship between successive flaps and (b) a central hole for receiving a mandrel which rotates the wheel. Each flap has on one of its surfaces abrasive particles facing outwardly from the annular surface. Each flap defines an acute angle with the annular surface and preferably extends at its opposite axial ends beyond the axial positions of support by such support surface to obtain a fixed positioning of the flaps relative to the support surface even at the axial positions beyond the axial ends of such annular surface. In a second embodiment, the flaps are disposed on the annular support surface in a tighter relationship than in the first embodiment so that each flap contacts adjacent flaps along a portion of its length. When the wheel is rotated with the flaps disposed adjacent a workpiece, the inner portions of the flaps provide an abrading action, partly because of their contact with one another, and the outer portions of the flaps provide a polishing action, partly because of their separation from one another. This polishing action is facilitated by the fact that (a) the flaps become separated from one another at their outer ends because of centrifugal action and (b) the grit on the flaps becomes progressively worn with progressive positions toward the outer ends of the flaps.

28 Claims, 5 Drawing Sheets

FIG. 1
PRIOR ART
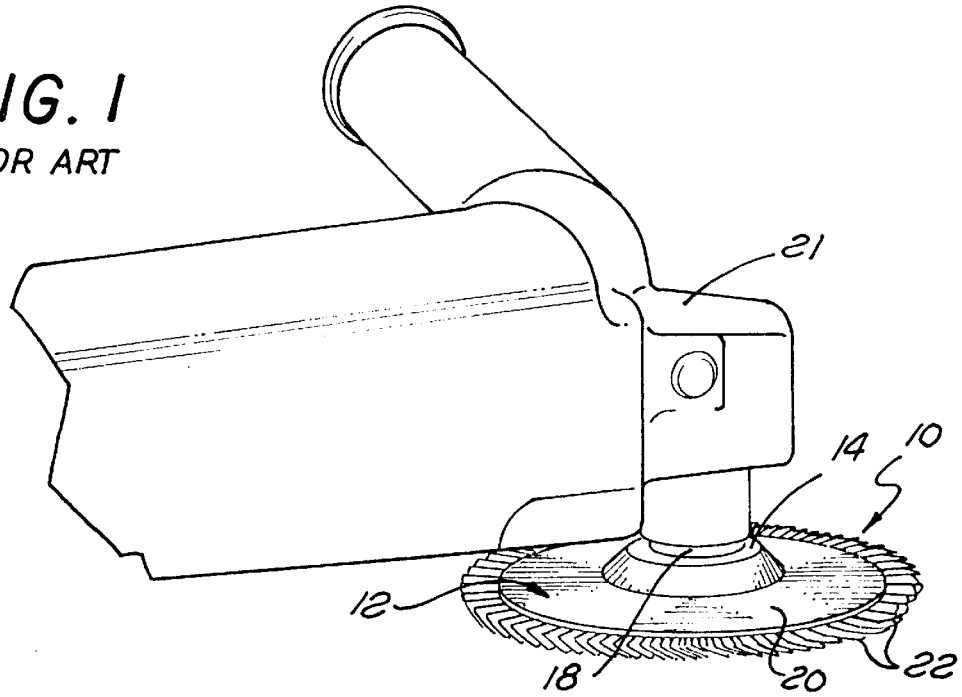
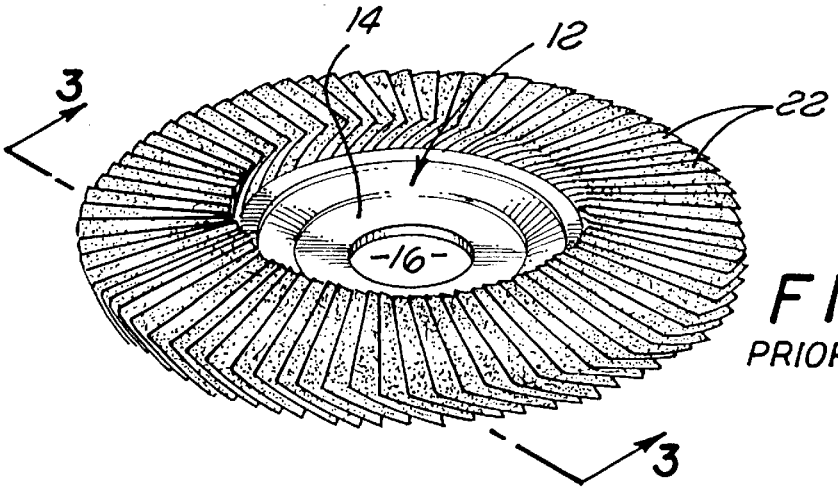
FIG. 2
PRIOR ART
FIG. 3
PRIOR ART
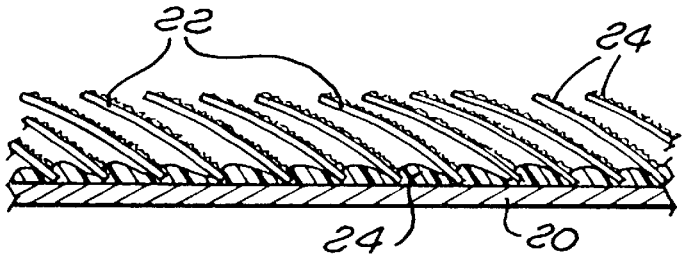

FLAP WHEEL

This is a continuation-in-part of patent application Ser. No. 08/706,438 now U.S. Pat. No. 5,722,881 filed by Graham W. Emerson on Aug. 30, 1996, for a "Flap Wheel" and assigned of record to the assignee of record of this application.

This invention relates to an abrasive wheel. More particularly, this invention relates to an abrasive wheel in which a plurality of abrasive flaps are axially disposed on one another in a progressive relationship on the radial periphery of a support member and in which each individual one of the abrasive flaps is disposed in a contacting relationship with adjacent flaps along a portion of the length of such individual one of the flaps.

BACKGROUND OF THE INVENTION

Abrasive wheels have been known for some time. In one type of abrasive wheel of the prior art, a plurality of abrasive flaps have been provided. Each flap has been coated on one side with abrasive particles. In certain embodiments of the prior art, the abrasive wheel has included a radially disposed disc for supporting the flaps.

In such embodiments of the prior art, the flaps have been attached to one surface of the disc so that each flap is disposed at an acute angle relative to the disc and in partially overlapping relationship to the adjacent flap in the plurality. In this relationship, a peripheral portion of each flap extends in an annular direction beyond the flap on which it is disposed. In this way, the progressive flaps define a complete ring.

When the wheel defined by the support disc and the flaps as discussed above rotates while disposed against a workpiece, the exposed portion of each flap abrades the workpiece. The abrasive wheel is advantageous because it is compact and strong and thus provides for a positive and controlled action on the workpiece.

The abrasive wheel discussed above is disadvantageous because it can be used only in a limited manner to abrade workpieces. This results from the disposition of the abrasive flaps on the disc such that the flaps are disposed in a substantially planar relationship on the disc. This limits the abrasive action of the abrasive wheel against workpiece surfaces which are exposed.

Abrasive wheels have also been known in the prior art where a support member has been provided with an annular surface defined by a constant radius at progressive positions on the surface. Abrasive flaps have been provided on this annular surface to abrade a workpiece surface. However, the abrasive flaps have been loosely disposed relative to one another on this annular surface. This loose relationship has limited the effectiveness of the flaps in abrading the workpiece surface. Furthermore, the axial widths of the flaps in such wheels have been limited to the axial widths of the members for supporting the flaps in such wheels.

The abrasive devices of the prior art have been limited in another important respect. They have been able to provide either an abrading action or a polishing action but have not been able to do both abrading and polishing. Abrading may be considered to constitute a coarser removal of material than polishing. It would be desirable for a device such as an abrasive wheel to provide both abrading and polishing actions.

BRIEF DESCRIPTION OF THE INVENTION

This invention provides an abrading and polishing wheel which combines the best features of the prior art discussed in the previous paragraphs. The abrading and polishing wheel of this invention is able to provide both an abrading action and a polishing action on a workpiece. The abrading and polishing wheel of this invention is also able to abrade and polish surfaces not capable of being abraded or polished by the prior art abrasive or polishing discs specified in the previous paragraphs. Furthermore, the abrading and polishing wheel of this invention is able to provide more positive abrading and polishing actions on such surfaces than the abrading and polishing wheel discussed in the immediately preceding paragraph. The abrading and polishing wheel of this invention is also advantageous because the flaps in such wheel have a greater axial width than the member supporting such flaps. This allows the abrading and polishing wheel of this invention to abrade and polish workpiece surfaces not capable of being abraded or polished by the abrasive wheels and the abrading discs of the prior art.

In one embodiment, a support member on an abrasive wheel has (a) an annular surface which fixedly supports (as by epoxy) a plurality of flaps in a partially overlapping relationship between successive flaps and (b) a central hole for receiving a mandrel which rotates the wheel. Each flap has on one of its surfaces abrasive particles facing outwardly from the annular surface. Each flap defines an acute angle with the annular surface and preferably extends at its opposite axial ends beyond the axial positions of support by such support surface to obtain a fixed positioning of the flaps relative to the support surface even at the axial positions beyond the axial ends of such annular surface.

In a second embodiment, the flaps are disposed on the annular support surface in a tighter relationship than in the first embodiment so that each flap contacts adjacent flaps along a portion of its length. When the wheel is rotated with the flaps disposed adjacent a workpiece, the inner portions of the flaps provide an abrading action, partly because of their contact with one another, and the outer portions of the flaps provide a polishing action, partly because of their separation from one another. This polishing action is facilitated by the fact that (a) the flaps become separated from one another at their outer ends because of centrifugal action and (b) the grit on the flaps becomes progressively worn with progressive positions toward the outer ends of the flaps.

BRIEF DESCRIPTION OF THE DRAWINGS

In the drawings:

FIG. 1 is a schematic perspective view of an abrasive disc of the prior art and of a tool for rotating the abrasive disc with the disc disposed against a workpiece surface;

FIG. 2 is an enlarged perspective view of the abrasive disc shown in FIG. 1 with the disc removed from the tool;

FIG. 3 is an enlarged fragmentary sectional view taken substantially on the line 3—3 in FIG. 2 and shows on a schematic basis the interrelationship between successive abrasive flaps on one surface of the disc;

DETAILED DESCRIPTION OF THE INVENTION

Figure 4:
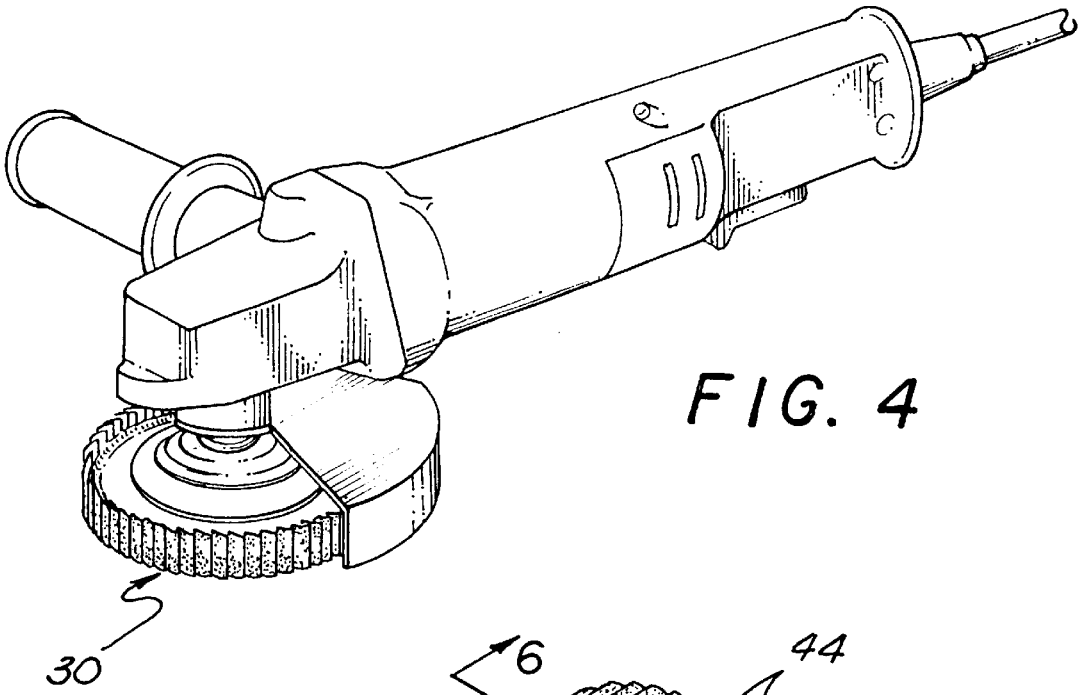
FIG. 4 is a schematic perspective view, similar to that shown in FIG. 1, of an abrasive wheel disclosed and claimed in application Ser. No. 08/706,438 (of which this application is a continuation-in-part) and a tool for rotating the abrasive wheel with the periphery of the wheel disposed against a workpiece surface.
Figure 5:
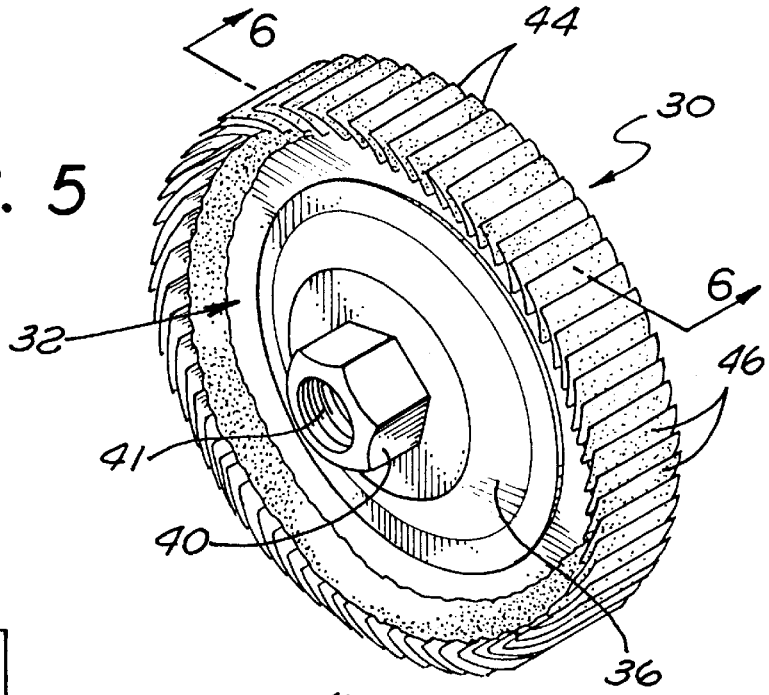
FIG. 5 is an enlarged perspective view of the embodiment of the abrasive wheel shown in FIG. 4 and shows the abrasive flaps and a member for supporting the flaps.
Figure 6:
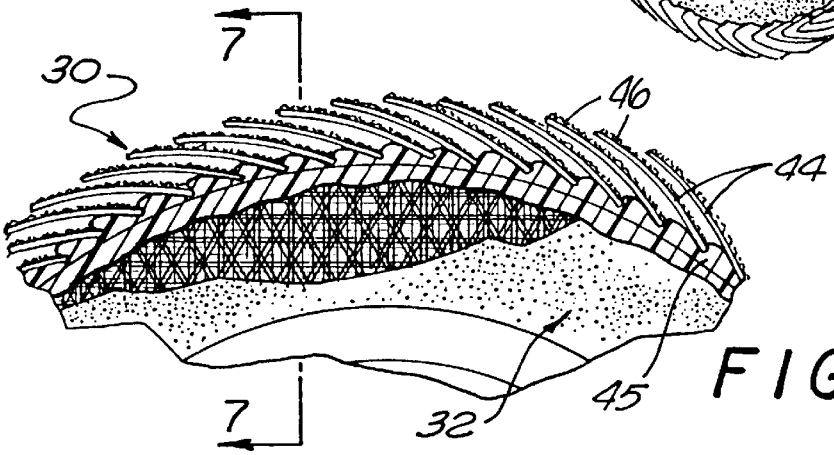
FIG. 6 is an enlarged fragmentary sectional view taken substantially on the line 6—6 in FIG. 5 and shows the support member and the interrelationship between successive flaps on the annular periphery of the wheel and the support member in the embodiment shown in FIGS. 4 and 5.
Figure 7:
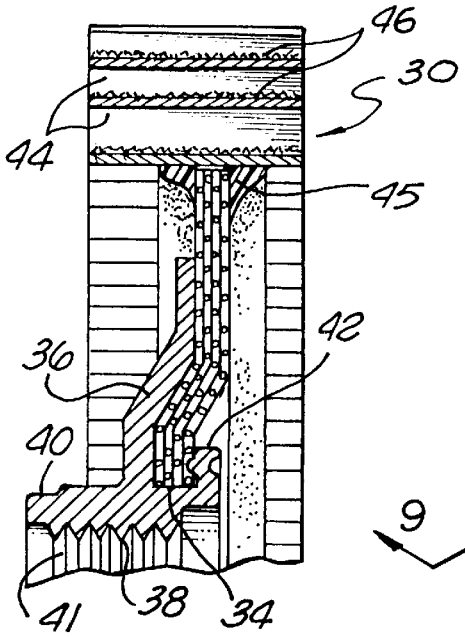
FIG. 7 is an enlarged fragmentary sectional view taken substantially on the line 7—7 of FIG. 6 and shows additional details of the support member and the attachment of the flaps to the support member in the embodiment shown in FIGS. 4–6.

FIGS. 1–3 illustrate an abrasive wheel, generally indicated at 10, of the prior art. The abrasive wheel 10 includes a support plate 12 which may preferably be made of a suitable material such as steel and which may be provided with an annular configuration. The support plate 12 may have an indented central portion 14 with a centrally disposed hole 16 for receiving a mandrel 18 for rotating the support plate.

The support plate 12 also includes a portion 20 disposed radially outwardly from the central portion 14. The portion 20 is preferably inclined at a relatively shallow angle from a planar configuration to facilitate the disposition of the abrasive wheel 10 against a workpiece surface (not shown) which is to be polished by the abrasive wheel. A tool 21 rotates the mandrel 18 and the abrasive wheel 10.

A plurality of abrasive flaps 22 are disposed on the portion 20 of the support plate 12. Each of the flaps 22 is formed from a thin strip of a backing material. Abrasive particles 24 are suitably secured to one surface of each of the flaps 22. The flaps 22 are disposed on one another in a partially overlapping relationship and are secured at their inner ends to the portion 20 of the support plate 12 as by a suitable material such as an epoxy 24. As shown in FIG. 3, the flaps 22 are separated from adjacent flaps along the lengths of the flaps. Furthermore, the epoxy 24 for securing the different flaps to the portion 20 of the support plate 12 is in a common plane.

Because of the partially overlapping relationship, the outer portion of each of the flaps 22 extends outwardly for a particular distance. This extension is essentially in an axial direction. Furthermore, because of this partially overlapping relationship, each of the flaps is disposed at an acute angle relative to the portion 20 of the support member 12. The flaps 22 have a rigid disposition relative to the portion 20 of the support member 12 even when the abrasive wheel 10 is rotated against a workpiece surface to be polished.

The abrasive wheel 10 has certain advantages but also has significant disadvantages. The rigid relationship between the different flaps 22 causes the flaps to be effective in abrading a surface of a workpiece when the portion 20 of the support plate 12 is disposed against the surface. However, the support plate 12 cannot be disposed against all surfaces because of the disposition of the support plate in the form of a disc.

Another disadvantage is that the flaps 22 provide either an abrading action or a polishing action on a workpiece depending upon the characteristics of the abrasive particles 24 on the flaps 22 but do not provide a combination of an abrading action and a polishing action on the workpiece. An abrading action may be considered to constitute a coarse removal of material from the surface of a workpiece. A polishing action may be considered to constitute a fine removal of material from the surface of the workpiece so that the surface of the workpiece becomes smooth.

FIGS. 4–7 show an abrasive wheel, generally indicated at 30, constituting one embodiment of an invention disclosed and claimed in application Ser. No. 08/706,438 filed by me on Aug. 30, 1996, for a "Flap Wheel" and constituting the parent of this continuation-in-part application. The abrasive wheel 30 includes a support member 32 which may be made from a suitable material such as fibers disposed in two (2) transverse (preferably perpendicular) directions in an interlocking relationship. This interlocking relationship may be defined by each fiber in one direction extending over alternate fibers, and then under the other fibers, in the second (or transverse) direction. Different warp and woof relationships in the fibers may be provided than that specified above without departing from the scope of the invention.

The support member 32 has a central hole 34. A support plate 36 also has a central hole 38. The support plate 36 is disposed on the support member 32 so that the central hole 34 in the support member and the central hole 38 in the support plate are aligned. The support plate 36 includes a protuberance 40 which defines an extension of the hole 38. This extension is internally threaded as at 41 to receive the threads on a mandrel (not shown) for rotating the abrasive wheel 30. The support plate 36 is disposed against one surface of the support member 32 and a flange 42 integral with the support plate is disposed against the other surface of the support member to maintain a fixed relationship between the support member and the support plate.

The support member 32 preferably has a disc-like configuration. A plurality of flaps 44 are attached as by an epoxy 45 to the support member 32 at the outer periphery of the support member. Abrasive particles 46 are suitably attached to one surface of each of the support flaps 44. The flaps 44 are disposed on the support member 32 in a partially overlapping relationship similar to that specified above for the prior art embodiment shown in FIGS. 1–3. In this relationship, the inner ends of the flaps 44 are attached to the support member 32 at the outer radial extremity of the support member and the outer ends of the flaps are exposed so that the abrasive particles 46 face outwardly.

In the embodiment shown in FIGS. 4–7, seventy-two (72) abrasive flaps 44 may be illustratively spaced at five degree (5°) intervals around the annular periphery of the support member 32. Each of the flaps 44 is attached to the annular periphery of the support member 32 as by the epoxy 45. Each of the flaps 44 does not overlap the adjacent flaps at the inner ends of the flaps or at the outer ends of the flaps.

It is only in the middle portion of each individual one of the flaps 44 that such flap overlaps adjacent flaps. The overlapping of the adjacent flaps 44 at the intermediate portion of each individual one of the flaps 44 does not involve any physical contact between the adjacent flaps and the intermediate portion of the individual one of the flaps because of the 5° separation between the flaps. This is illustratively shown in FIG. 6.

The axial dimension of each of the flaps 44 is preferably greater than the axial width of the support member 32. Preferably the flaps 44 are disposed on the support member 32 so that the flaps 44 extend axially beyond the support member 32 at the opposite axial ends of each of the side surfaces of the support member. For example, when the support member has a diameter of approximately four (4) inches and the support member has a thickness of approximately one quarter of an inch (¼"), the flaps 44 may have an axial dimension of approximately one (1) inch. Preferably the axial extension of the flaps 44 beyond the support member 32 is equal on the opposite sides of the support member.

Each of the flaps 44 may preferably have a length of approximately five eighths of an inch (⅝"). Each flap may overlap the adjacent flap by a distance of approximately three eighths of an inch (⅜") and may extend beyond such adjacent flap by a distance of approximately three sixteenths of an inch (3/16"). In the overlapping relationship, each of the flaps 44 is disposed at an acute angle relative to the annular periphery of the support member 32 at the position at which such flap is attached as by the epoxy 45 to the support surface.

The abrasive wheel 30 has certain important advantages. It is able to abrade or polish surfaces not capable of being abraded or polished by the abrasive wheels of the prior art. This results from the extension of the abrasive flaps 44 in the axial direction beyond the axial periphery of the support member 32 at the opposite axial ends of the support member.

The effective abrading or polishing action of the abrasive wheel 30 shown in FIGS. 4–7 additionally results from the firm and solid relationship between the adjacent flaps 44 around the annulus defined by the flaps even at the axial positions of the flaps beyond the support member 32. Because of this firm and solid relationship, the flaps 44 are able to provide an effective abrading or polishing action on the workpiece surface when such workpiece surface is contacted by such flaps.

Figure 8:
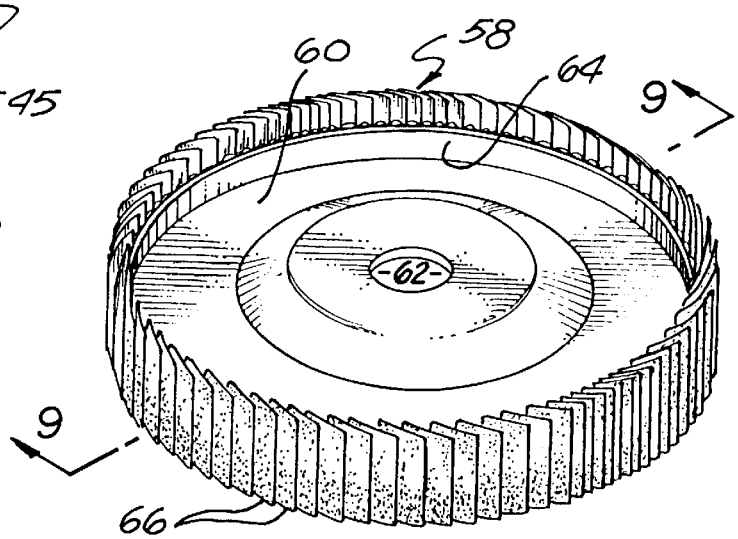
FIG. 8 is a perspective view showing a second embodiment of an abrasive wheel disclosed and claimed in application Ser. No. 08/706,438 and shows a support member and abrasive flaps on the support member in such abrasive wheel.
Figure 10:
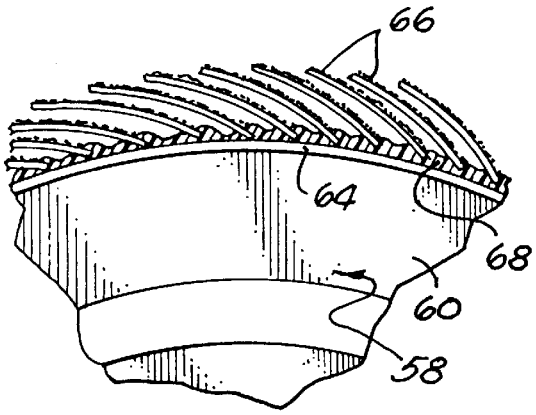
FIG. 10 is an enlarged fragmentary sectional view taken substantially on the line 10—10 of FIG. 9 and shows additional details of the interrelationship between the support member and the flaps in the abrasive wheel shown in FIGS. 8 and 9.
Figure 9:
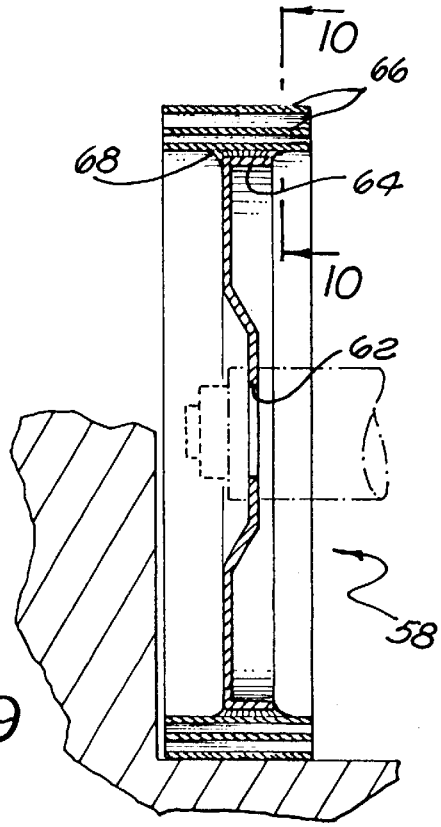
FIG. 9 is a sectional view taken substantially on the line 9—9 of FIG. 8 and shows additional details of the interrelationship between the support member and the flaps in the abrasive wheel shown in FIG. 8.
Figure 11:
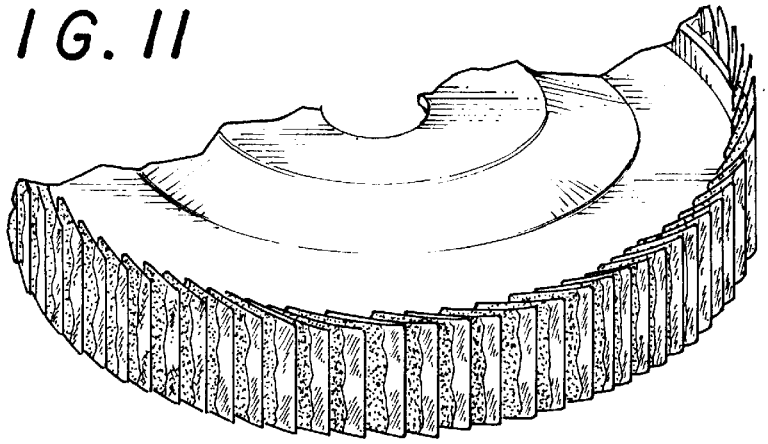
FIG. 11 is a fragmentary perspective schematic view of an abrasive wheel constituting another embodiment of the invention and shows the relative disposition of successive flaps on the wheel.
Figure 12:
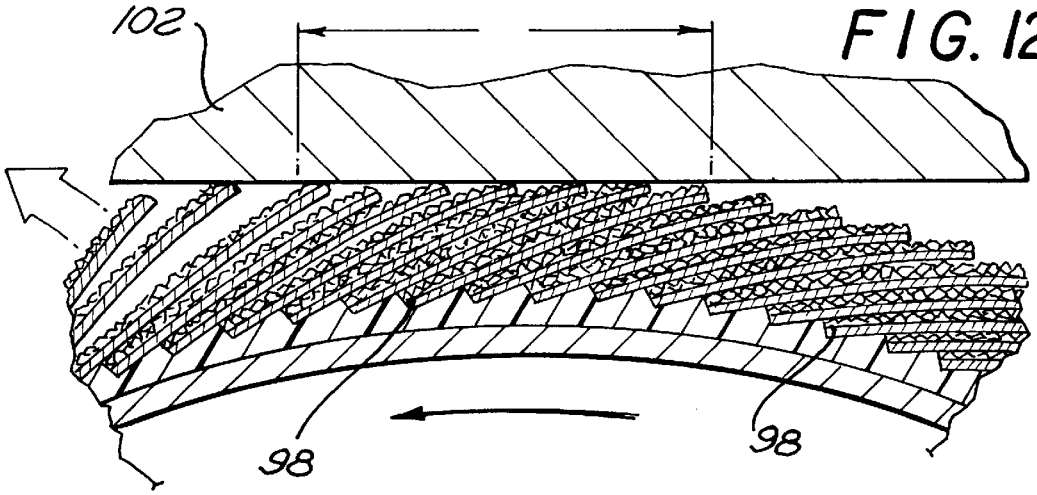
FIG. 12 is an enlarged fragmentary sectional schematic view of a portion of the wheel shown in FIG. 11, this view being similar to that shown in FIG. 6, and shows the wheel rotatably disposed against a surface of a workpiece when the wheel is new and before any use is made of the wheel in abrading or polishing the surface of the workpiece.
Figure 13:
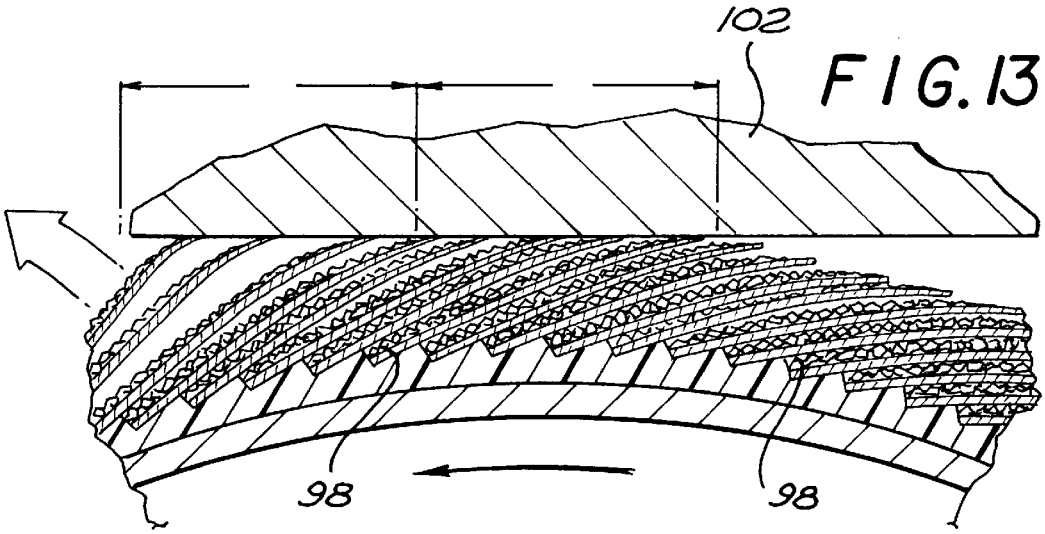
FIG. 13 is an enlarged fragmentary sectional schematic view of a portion of the wheel shown in FIGS. 11 and 12, this view being similar to that shown in FIGS. 6 and 11, and shows the wheel rotatably disposed against a workpiece when the flaps in the wheel have become partially worn.

FIGS. 8–10 show an abrasive wheel, generally indicated at 58, constituting a second embodiment of the invention. In this embodiment, a support plate 60 having a disc-like configuration is provided with a central hole 62 for receiving a mandrel (not shown) and with an annular flange 64 at the radially outward end of the support plate. Flaps 66 corresponding to the flaps 44 (FIGS. 4–7) are attached as by an epoxy 68 to the flange 64 at the inner ends of the flaps. Successive ones of the flaps 66 may have a partially overlapping relationship with respect to the adjacent flaps corresponding to the partially overlapping relationship of the flaps 44. The flaps 66 preferably extend axially beyond the flange 64 at the opposite axial ends of the flaps.

The embodiment shown in FIGS. 8–10 has all of the advantages discussed above for the embodiment shown in FIGS. 4–7. In addition, the embodiment shown in FIGS. 8–10 has a simpler construction than the embodiment shown in FIGS. 4–7. This results in part from the replacement of the support member 32 and the support plate 36 in FIGS. 4–7 by the support plate 60 in FIGS. 8–10. The embodiment shown in FIGS. 7–10 is also advantageous in that the flange 64 on the support plate 60 provides a firm support for the flaps 66.

FIGS. 11–16 illustrate an embodiment of the invention individual to this continuation-in-part application. The embodiment shown in FIGS. 11–16 is similar to the embodiment shown in FIGS. 4–7 in the construction of the support member 32 and the support plate 36 and in the manner of disposing the abrasive flaps 44 on the workpiece. Although an embodiment similar to that shown in FIGS. 8–10 is not shown with the constructional details shown in FIGS. 11–16, it will be appreciated that such an embodiment is within the scope of the invention. The construction of this embodiment will be obvious to a person of ordinary skill in the art from the showing in FIGS. 11–16 and from the following description.

In the embodiment shown in FIGS. 11–16, one hundred and twenty (120) flaps 44 are illustratively spaced at three degree (3°) intervals around the annular periphery of the support member 32. As in the embodiment shown in FIGS. 4–7, each of the flaps 44 is attached to the annular periphery of the support member 32 as by the epoxy 45. Each individual one of the flaps 44 does not overlap the adjacent flaps at the inner end of such individual one of the flaps or at the outer end of such individual one of the flaps.

It is only in the middle portion of each individual one of the flaps 44 that such flap overlays or overlaps adjacent flaps. Contrary to the embodiment shown in FIGS. 4–7, the overlapping of the intermediate portion of each individual one of the flap 44 with the adjacent flaps involves a physical contact between such individual one of the flaps and the adjacent flap in the overlapping region. This is illustratively shown at 98 in FIGS. 12 and 13.

Figure 14:
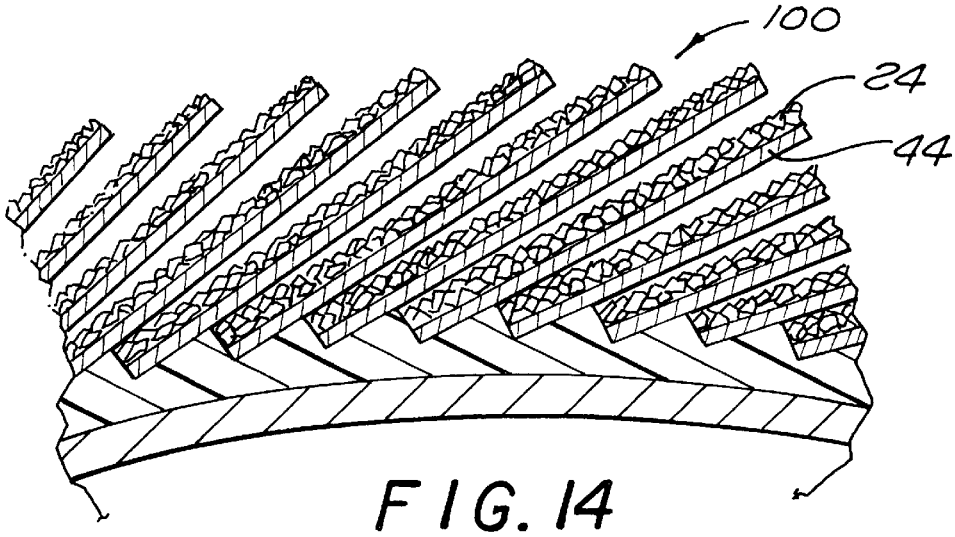
FIG. 14 is an enlarged fragmentary sectional schematic view of a new wheel similar to that shown in FIG. 11 and shows the relative disposition of adjacent flaps on the wheel, and the disposition of abrasive particles on the flaps, before any abrading or polishing use of the wheel.

When a new wheel generally indicated at 100 as shown in FIG. 14 is disposed against a workpiece 102 (FIGS. 12 and 13) and the wheel is rotated, the outer end of each flap 44 is disposed against the workpiece. An abrading action is accordingly provided by the abrasive particles 24 against the workpiece. This abrading action causes the abrasive particles 24 to become partially worn. The wearing of the abrasive particles 24 increases progressively toward the outer ends of the flaps 44. This progressive wearing of the abrasive particles 24 toward the outer ends of the flaps 44 is schematically illustrated at 104 in FIG. 15.

Figure 15:
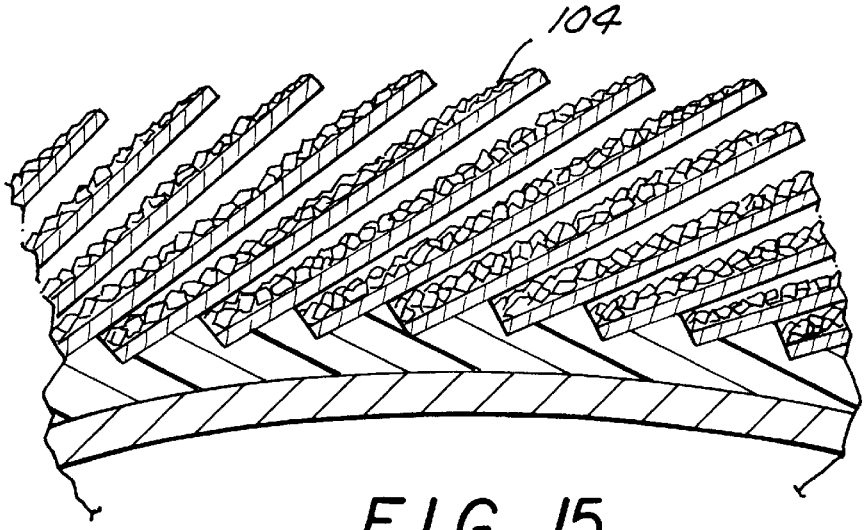
FIG. 15 is an enlarged fragmentary sectional schematic view of a wheel similar to that shown in FIG. 11 and shows the relative disposition of adjacent flaps on the wheel and the partial wearing of the grit at the outer ends of these flaps after the flaps have been disposed against a workpiece.
Figure 16:
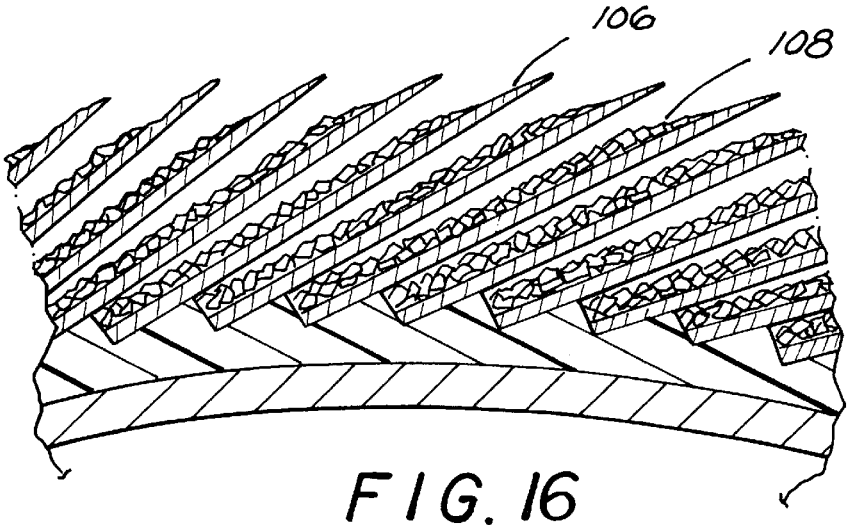
FIG. 16 is an enlarged fragmentary sectional view of a wheel similar to that shown in FIG. 11 and shows the relative disposition of adjacent flaps and the wearing of the grit at the outer ends of these flaps after the wheel has become worn through an extended usage.

With continued rotation of the wheel 100 against the workpiece 102, the outer ends of the flaps 44 become worn so that no abrasive particles exist at the outer ends of the flaps. This is illustrated schematically at 106 in FIG. 16. However, as the outer ends of the flaps 44 become worn, the abrasive particles 24 adjacent the worn ends 106 become progressively worn. This is illustrated schematically at 108 in FIG. 16. As will be seen, the partially worn abrasive particles 108 in FIG. 15 are inward along the flaps 44 from the partially worn abrasive particle 104 in FIG. 14.

As the outer ends of the abrasive flaps 44 become progressively worn, progressive portions of the flaps inwardly from the outer ends of the flaps become exposed. These progressive portions of the flaps 44 inwardly from the outer ends of the flaps have particles 24 which have not been previously disposed against the workpiece 102. These particles 24 are thus able to provide a full abrading action.

It will accordingly be seen that the exposed inner ends of the flaps 44 provide an abrading action because the particles at these inner ends are newly exposed and are at full strength. This abrading action is enhanced because the intermediate portion of each individual one of the flaps 44 engages the adjacent flaps so that the action of the intermediate portion of each individual one of the flaps is fortified or solidified by the engaging portions of the adjacent flaps.

The abrading action provided by the flaps 44 progressively decreases in intensity with progressive positions on the flaps toward the outer ends of the flaps. As the abrading action progressively decreases in intensity towards the outer ends of the flaps 44, the polishing action of the flaps progressively increases. As will be appreciated, this polishing action is more gentle than an abrading action. The increase in the polishing action at the progressive positions towards the outer ends of the flaps 44 results in part from the fact that the amount of material on the abrasive particles 24 progressively decreases with progressive positions towards the outer ends of the flaps because the abrasive particles have become progressively worn towards the outer ends of the flaps.

The increase in the polishing action at the progressive position towards the outer ends of the flaps 44 also results in part from the fact that the flaps 44 become progressively separated from one another at their outer ends during the wheel rotation because of the centrifugal forces exerted on the flaps. The increased separation of the flaps 44 at the outer ends of the flaps causes a softened action to be provided by the abrasive particles 24 on the outer ends of the flaps 44 against the workpiece.

In this way, most of the area in each flap 44 can be used to provide a combination of an abrading action and a polishing action. The provision of the combination of an abrading action and a polishing action by the abrasive flaps 44 in the wheel 100 constitutes an important feature of the invention. Since each flap 44 in the wheel 100 abrades and polishes the workpiece 102, the wheel provides no chatter marks on the surface of the workpiece 102. In view of the combined action of abrading and polishing by each of the flaps 44 on the workpiece 102, the abrasive particles 24 can be provided with a coarsened grain without affecting the fineness of the polishing action. This shortens the time required to abrade the surface of the workpiece 102.

Because of the relatively soft abrading and polishing actions provided by each of the flaps 44, the wheel 100 experiences no bounce when the flaps contact the workpiece. Actually, the wheel 100 has a resilience in contacting the surface of the workpiece 102. This resilience causes the wheel 100 to be forgiving when used by a novice and causes the wheel to have flexible properties when used by a skilled workman. These flexible properties allow the skilled workman to provide abrading and polishing actions with a high precision on the surface of the workpiece 102.

The wheel 100 also operates on a relatively cool basis because of the separation between the flaps 44 during the rotation of the wheel against the workpiece 102 and because of the polishing action at the outer tips of the flaps. The wheel 100 also operates on a quieter basis than the wheels of the prior art because of the relatively soft abrading action and because of the polishing action at the outer ends of the flaps 44. The axial overhangs provided at the opposite axial ends of the flaps 44 also allow the wheel 100 to grind the surface of a workpiece in tight corners such as corners having angles of 90°. Such corners illustratively occur at the bottoms of tanks and cylinders. The abrasive wheel 100 is also able to provide edge grinding.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

I claim:

1. A wheel for abrading and polishing a surface of a workpiece in accordance with a rotation of the wheel, including a support member rotatable on a particular axis, first means extending radially from the support member and having an outer radial end and having an outer periphery at its outer radial end having an annular rim at its outer radial periphery, the annular rim having a width extending axially beyond the first means, a plurality of flaps, each individual one of the flaps having an inner end and an outer end and each individual one of the flaps extending axially along the width of the rim and each individual one of the flaps extending from the annular rim at an angle relative to the annular rim and each individual one of the flaps being disposed on adjacent ones of the flaps in contact with adjacent ones of the flaps along a first portion of the length of such individual one of the flaps and in spaced relationship with the adjacent ones of the flaps along a second portion of the length of the individual one of the flaps, the flaps being disposed around the complete periphery of the annular rim, each of the flaps having abrasive particles on the flap, the abrasive particles having characteristics at first positions on the second portions of the flaps to provide an abrading action on the workpiece, and the abrasive particles having characteristics at second positions on the second portions of the flaps to provide a polishing action on the workpiece, second means for attaching the flaps to the annular rim at the inner ends of the flaps to retain the flaps in a substantially fixed relationship to one another and to the annular rim, with each rim disposed at the angle relative to the annular rim in the non-rotated relationship of the wheel and with a portion of each flap separated from the adjacent flaps during the rotation of the wheel and the application of the wheel against the workpiece surface.

2. A wheel as set forth in claim 1 wherein the support member is substantially rigid and wherein the flaps have first and second opposite ends defining the width of the rim and wherein the flaps extend axially beyond the width of the rim at the first and second opposite ends of the rim.

3. A wheel as set forth in claim 1 wherein the second means constitutes an epoxy attached to the inner ends of the abrasive flaps and the annular rim.

4. A wheel as set forth in claim 1 wherein the flaps extend at an acute angle from the annular periphery of the rim of the support member and each individual one of the flaps contacts the adjacent flaps along an intermediate portion of the length of such individual one of the flaps.

5. A wheel as set forth in claim 2 wherein the second means constitutes an epoxy attached to the inner ends of the abrasive flaps and the annular rim, the flaps extend at an acute angle form the annular periphery and each individual one of the flaps contacts the adjacent flaps along an intermediate portion of the length of such individual one of the flaps.

6. A wheel for abrading and polishing a surface of a workpiece, including, a substantially rigid member having a looped configuration a plurality of flaps, each individual one of the flaps having inner and outer ends and disposed in contact with adjacent flaps in the radial direction on the member at position intermediate the inner and outer ends of the individual one of the flaps and being separate from the adjacent flaps at an outer end of the individual one of the flaps, the flaps being disposed around the looped configuration of the member, and means disposed on the flaps in abutting relationship to the member for retaining the inner end of the flaps on the member in an overlapping relationship during the rotation of the abrasive wheel and the application of the abrasive wheel against the surface of the workpiece each of the flaps having abrasive particles on the flap, the abrasive particles having characteristics at first positions on the outer ends of the flaps to provide an abrading action on the workpiece, and the abrasive particles having characteristics at second positions on the outer ends of the flaps to provide a polishing action on the workpiece.

7. A wheel as set forth in claim 6 wherein the contact between the intermediate portion of each individual one of the flaps and the flaps adjacent such individual one of the flaps provides for an abrasive action on the surface of the workpiece when the flaps contact the workpiece surface and wherein each individual one of the flaps becomes separated from the adjacent flaps at the outer end of such individual one of the flaps during the rotation of the wheel and wherein the separation between each individual one of the flaps and the adjacent flaps at the outer end of such individual one of the flaps provides for a polishing action on the surface of the workpiece when the flaps contact the workpiece surface at the outer ends of the flaps.

8. A wheel as set forth in claim 6 wherein the flaps are disposed relative to one another to provide for an abrading action against the workpiece by an intermediate portion of the flaps along the lengths of the flaps during the rotation of the wheel and to provide for a polishing action against the workpiece by an outer portion of the flaps along the lengths of the flaps during the rotation of the wheel.

9. A wheel as set forth in claim 6 wherein the flaps are disposed relative to one another to provide for a contact between an intermediate portion of each individual one of the flaps along the length of such individual one of the flaps and an inner portion of the flap contiguous to the individual one of the flaps on one side of the individual one of the flaps and to provide for a contact between each individual one of the flaps and an outer portion of the flap contiguous to the individual one of the flaps on the other side of the individual one of the flaps.

10. A wheel as set forth in claim 6 wherein the substantially rigid member has opposite ends defining a particular dimension in the axial direction and wherein the flaps have a width greater than the particular dimension and wherein the flaps are disposed so that they extend axially beyond the second portion of the substantially rigid member at the opposite ends of the substantially rigid member.

11. A wheel as set forth in claim 7 wherein the flaps are disposed relative to another to provide for a contact between an intermediate portion of each individual one of the flaps along the length of such individual one of the flaps and an inner portion of the flap contiguous to the individual one of the flaps on one side of the individual one of the flaps and to provide for a contact between the intermediate portion of each individual one of the flaps along the length of such flap and an outer portion of the flap contiguous to the individual one of the flaps on the other side of the individual one of the flaps, the second portion of the substantially rigid member has opposite ends defining a particular dimension in the axial direction and wherein the flaps have a width greater than the particular dimension and wherein the flaps are disposed so that they extend axially beyond the second portion of the substantially rigid member at the opposite ends of the substantially rigid member.

12. A wheel for abrading and polishing a surface of a workpiece in accordance with a rotation of the wheel, including, a support member extending in a radial direction and having an outer periphery and having an axially disposed rim at its outer periphery, the rim having an annular configuration, a plurality of abrasive flaps having inner and outer ends and disposed on one another at their inner ends on the axially disposed rim in a partially overlapping relationship to one another in the radial direction before any rotation of the wheel, the flaps being disposed relative to one another and being constructed to provide for an abrading action by a first portion having abrasive particles of a first characteristic of each flap against the workpiece surface during the rotation of the abrasive wheel and to provide for a polishing action by a second portion having abrasive particles of a second characteristic, displaced from the first portion, of such flap against the workpiece during the rotation of the abrasive wheel, and means for attaching the inner ends of the flaps to the radially disposed rim in the overlapping relationship of the abrasive flaps before any rotation of the wheel.

13. A wheel as set forth in claim 12 wherein the first portion of each flap is intermediate the inner and outer ends of such flap and the second portion of each flap is near the outer end of such flap.

14. A wheel as set forth in claim 12 wherein the first portion of each flap is contacted by the adjacent flaps during the rotation of the wheel to facilitate the abrading action and wherein the second portion of each flap is separated from the adjacent flaps during the rotation of the wheel to facilitate the polishing action.

15. A wheel as set forth in claim 12 wherein the flaps have abrasive particles and wherein the abrasive particles on the second portion of the flaps become partially worn and wherein the abrasive particles on the first portion of the flaps are not worn as much as the abrasive particles on the second portion of the flaps.

16. A wheel as set forth in claim 14 wherein the first portion of each flap is intermediate the inner and outer ends of such flap and the second portion of each flap is near the outer end of such flap, the flaps have abrasive particles and wherein the abrasive particles on the second portion of the flaps become partially worn and wherein the abrasive particles on the first portion of the flaps are not worn as much as the abrasive particles on the second portion of the flaps.

17. A wheel as set forth in claim 13 wherein the rim has a particular dimension in an axial direction and wherein the flaps have a length greater than the particular dimension and wherein the flaps are disposed on the rim so that they extend beyond the rim at the opposite axial ends of the rim.

18. A wheel for abrading and polishing a surface of a workpiece, including a support member extending in a radial direction and having an outer periphery and having an axially disposed rim at its outer periphery, the rim having an annular configuration, a plurality of flaps having inner and outer ends, each individual one of the flaps being disposed in an overlapping relationship to adjacent flaps and contacting the adjacent flaps along a portion of its length and being separated from the adjacent flaps along the remaining portion of its length, the flaps having opposite surfaces and holding abrasive particles on one of its opposite surfaces, and means for attaching the flaps to the axially disposed rim at the inner ends of the flaps each of the flaps having abrasive particles on the flap, the abrasive particles having characteristics at first positions along the remaining portion of the length of the flaps to provide an abrading action on the workpiece, and the abrasive particles having characteristics at second positions along the remaining portion of the length of the flaps to provide a polishing action on the workpiece.

19. A wheel as set forth in claim 18 wherein the contact between each individual one of the flaps and the adjacent flaps occurs at an intermediate portion of the individual one of the flaps between the inner and outer ends of such individual one of the flaps.

20. A wheel as set forth in claim 18 wherein the flaps are disposed so that the abrasive particles at progressive distances approaching the outer ends of the flaps become progressively worn by the application of the wheel against the workpiece during the rotation of the wheel and the abrasive particles at positions on the flaps progressively displaced toward the inner ends of the flaps from the worn particles in the flaps become exposed to provide an abrading action on the workpiece as the abrasive particles at the progressive displacements toward the inner ends of the flaps from the worn particles in the flaps become progressively worn.

21. A wheel as set forth in claim 18 wherein each of the flaps extends outwardly from the rim in a direction having a radial component and the flaps are disposed on the rim for subjection to centrifugal forces during the rotation of the wheel thereby to become separated from one another at their outer ends and facilitate the polishing action of the flaps at the outer ends of the flaps.

22. A wheel as set forth in claim 19, the flaps are disposed so that the abrasive particles at progressive displacements toward the inner ends of the flaps from the outer ends of the flaps become progressively worn by the application of the wheel against the workpiece during the rotation of the wheel and the abrasive particles at positions on the flaps progressively displaced toward the inner ends of the flaps from the worn particles in the flaps become exposed to provide an abrading action on the workpiece as the abrasive particles at the progressive displacements toward the inner ends of the flaps from the outer ends of the flaps become progressively worn and wherein each of the flaps extends outwardly from the rim in a direction having a radial component and the flaps are disposed on the rim for subjection to centrifugal forces during the rotation of the wheel thereby to become separated from one another at their outer ends and facilitate the polishing action of the flaps at the outer ends of the flaps.

23. A wheel as set forth in claim 19 wherein the rim of the support member has a particular dimension in an axial direction and wherein the flaps have a length greater than the particular dimension and wherein the flaps are disposed on the rim so that they extend beyond the rim at the opposite axial ends of the rim.

24. A wheel for abrading and polishing a surface of a workpiece, including, a substantially rigid member having a looped configuration, a plurality of flaps disposed on the member around the looped configuration of the member, means disposed on the flaps in abutting relationship to the member for retaining inner ends of the flaps on the member in an overlapping relationship during the rotation of the abrasive wheel and the application of the abrasive wheel against the surface of the workpiece, the flaps being disposed relative to one another on the member and being constructed to provide an abrading action with the flaps having abrasive particles of a first characteristic, and simultaneously a polishing action with the flaps having abrasive particles of a second characteristic, on the surface of the workpiece during the rotation of the wheel and the application of the wheel against the surface of the workpiece.

25. A wheel as set forth in claim 24 wherein, the member has opposite axial ends and has a particular dimension between the opposite axial ends and the flaps have a length greater than the particular dimension and wherein the retaining means are disposed on the inner ends of the flaps along the lengths of the flaps and wherein the flaps extend axially beyond the member at the opposite axial ends of the member.

26. A wheel as set forth in claim 24 wherein the flaps provide the abrading action on the surface of the workpiece in a first portion of the flaps during the rotation of the wheel and the application of the wheel against the workpiece and provide the polishing action on the surface of the workpiece in a second portion of the flaps during the rotation of the wheel and the application of the wheel against the workpiece.

27. A wheel as set forth in claim 24 wherein the flaps engage one another at first portions of the flaps and wherein the flaps provide the abrading action at second portions of the flaps near the first portions of the flaps and the flaps provide the polishing action at third portions of the flaps further removed from the first portions of the flaps than the second portions of the flaps.

28. A wheel as set forth in claim 25 wherein the flaps provide the abrading action on the surface of the workpiece in a first portion of the flaps during the rotation of the wheel and the application of the wheel against the workpiece and provide the polishing action on the surface of the workpiece in a second portion of the flaps during the rotation of the wheel and the application of the wheel against the workpiece and wherein the flaps engage one another at third portions of the flaps and wherein the second portions of the flaps are further removed from the third portions of the flaps than the first portions of the flaps.

* * * * *